United States Patent [19]

Behling et al.

[11] Patent Number: 4,892,454

[45] Date of Patent: Jan. 9, 1990

[54] REFUSE COLLECTING VEHICLE

[75] Inventors: Hans-Jurgen Behling, Hannover; Friedrichwilhelm Schmadeke, Neustadt, both of Fed. Rep. of Germany

[73] Assignee: Schorling GmbH & Co., Hanover, Fed. Rep. of Germany

[21] Appl. No.: 226,939

[22] Filed: Aug. 1, 1988

[30] Foreign Application Priority Data

Apr. 8, 1988 [DE] Fed. Rep. of Germany ..... 3811716

[51] Int. Cl.[4] ..... B65F 3/20

[52] U.S. Cl. ..... 414/406; 414/525.55; 414/512; 414/517; 100/233

[58] Field of Search ..... 414/511, 512, 513, 516, 414/517, 518, 521, 525.2, 525.55, 406, 525.6, 525.3, 525.4, 525.5, 525.51, 525.52, 525.53, 525.54; 100/233

[56] References Cited

U.S. PATENT DOCUMENTS

| | | | |
|---|---|---|---|
| 3,402,837 | 9/1968 | Palmer et al. | 414/517 |
| 3,410,427 | 11/1968 | McCarthy | 414/517 |
| 3,486,644 | 12/1969 | Bakker et al. | 414/525.55 X |
| 3,490,631 | 1/1970 | Smith | 414/525.6 X |
| 3,542,225 | 11/1970 | Knight | 414/515.55 X |
| 3,890,889 | 6/1975 | Fishburne | 414/525.6 X |
| 4,005,789 | 2/1977 | Gladwin et al. | 414/525.2 X |
| 4,088,234 | 5/1978 | Smith | 414/515.55 |
| 4,096,959 | 6/1978 | Schäffler | 414/525.55 X |
| 4,180,365 | 12/1979 | Herpich et al. | 414/525.52 |
| 4,473,333 | 9/1984 | Stuart | 100/233 X |

FOREIGN PATENT DOCUMENTS

| | | |
|---|---|---|
| 2126780 | 2/1972 | Fed. Rep. of Germany . |
| 2318174 | 10/1973 | Fed. Rep. of Germany . |
| 291453 | 10/1979 | Fed. Rep. of Germany . |

*Primary Examiner*—Robert J. Spar
*Assistant Examiner*—Robert S. Katz
*Attorney, Agent, or Firm*—Collard, Roe & Galgano

[57] ABSTRACT

A refuse-collecting utility vehicle with a refuse-charging system located behind the driver's cabin has an adjoining refuse-compacting device and a refuse-collecting bin arranged behind the compacting device. A dual compaction system makes it possible to accomplish uniform compaction of the refuse charged within the refuse-collecting bin, so that the capacity of the refuse-collecting bin is exploited to its fullest capacity. Specifically, a counterpressure plate is arranged within the zone of action of the refuse-compacting device on the top of the refuse-collecting bin. This counterpressure plate is supported for upward and downward pivotal movement and is capable of being acted upon by a pressure force and forms a counterpressure element for the refuse charged. This permits unniform compaction of the refuse filled in the refuse-collecting bin from the start of refuse-charging up until the complete filling of the bin Thus, this system results in an increased utilization of or an increased payload for the refuse-collecting vehicle.

7 Claims, 4 Drawing Sheets

FIG. 3
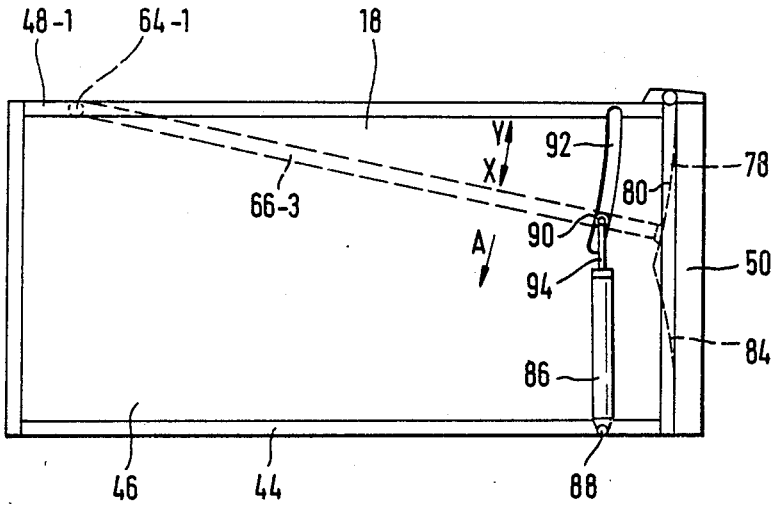
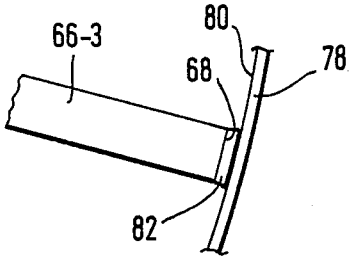
FIG. 4

REFUSE COLLECTING VEHICLE

BACKGROUND OF THE INVENTION

1. The Field of the Invention

This invention relates to a refuse-collecting vehicle which is capable of holding an increased quantity of refuse in a given volume. Specifically, the invention relates to the inclusion of a counterpressure plate which acts in combination with the loading system to insure complete compacting of the refuse.

2. Description of the Prior Art

The present state of the art in refuse collecting vehicles is taught in German Patent No. 34 01 069. In this prior art refuse collecting vehicle, the refuse loaded in a refuse hopper is pushed by a refuse-compacting plate from a compacting space, which is disposed beneath the refuse hopper and into the actual refuse collecting bin of the refuse collecting vehicle. At the start, i.e., when the refuse bin is still empty, no compacting of the refuse takes place because a pressure element component counteracting the pushing pressure is missing when the refuse bin is empty. Only after enough additional refuse has been pushed into the refuse bin to cause the refuse to pile up on the rear wall of the refuse bin, i.e., after the latter has been filled across its entire length, a certain amount of counterpressure is generated and acts upon the refuse as the latter is pushed into the bin.

Due to the great length across which the refuse accumulates, such length corresponding with the length of the refuse bin, the counterpressure results in a totally insufficient and uneven compacting of the refuse. This insufficient compaction occurs mainly within the rear zone of the refuse bin. Consequently, only an unduly limited quantity of refuse can be accommodated in the refuse bin, which means the known refuse collecting vehicle is not operating at its full capacity.

Another refuse collecting vehicle is disclosed in German published patent disclosure No. DE-OS 32 44 216. With this vehicle, a shield for pushing out the refuse is arranged in the refuse-collecting bin. This shield is adjustable or displaceable from the area of the refuse inlet opening in the direction of the refuse outlet opening of the refuse collecting bin, with a refuse-charging hopper being arranged ahead of the shield. On the bottom side, the rear wall of the refuse-charging hopper and the shield for pushing out the refuse are connected by a common passage, in which a compacting plunger is operating. The charged refuse drops via the charging hopper in front of the compacting plunger and is pushed by the latter into the refuse collecting bin through the passage of the shield.

As with the other prior art vehicles, in this refuse collecting vehicle the refuse is not actually compacted until the refuse-collecting bin has been filled across its length and the refuse piles up against the rear wall of the bin. Furthermore, the buildup of back pressure and thus counterpressure for compacting is made difficult because the back wall has a semi-spherical shape so that the refuse is forced upwardly yielding as it is pushed against the rear wall. Thus, this refuse collecting vehicle is not operating at full capacity because effective compacting is absent.

Finally, another refuse collecting vehicle is taught in Germany published patent disclosure No. DE-OS 34 20 058. This vehicle is equipped with an exchangeable receptacle for receiving the refuse. The space receiving the refuse, which has an inlet or filling opening, a conveying chamber and a pressing plunger, is rigidly arranged between the driver's cabin and the exchangeable refuse receptacle. The refuse, which is collected from a refuse bin with the help of a lifting and tilting device, is loaded in the conveying chamber ahead of the pressing plunger, and is forced or pressed by the latter into the exchangeable receptacle.

With this refuse-collecting vehicle, the refuse is also loaded in the exchangeable receptacle without actually being compacted. The compacting action starts only after the refuse completely fills the exchangeable receptacle across its entire length. Both the compaction of the refuse and the filling of the exchangeable receptacle is also considered to be unsatisfactory with this design as well.

SUMMARY OF THE INVENTION

It is an object of the invention to provide a refuse-collecting vehicle permitting improved and nearly uniform compaction of the refuse charged in order to increase the quantity of refuse loadable in the refuse-collecting bin of the vehicle.

It is another object of the invention to provide a refuse collecting vehicle having a compaction system in which counter-pressure is applied by a plate which acts against the pressure generated by the refuse charging system of the vehicle.

It is yet another object of the invention to provide a refuse collecting vehicle having a compaction system which is simple in design, easy to operate and which produces uniform compaction of the refuse in the vehicle.

Accordingly, these objects are accomplished with a refuse-collecting vehicle that has a driver's cabin mounted on a forward portion of an undercarriage. The vehicle includes a refuse-collecting bin mounted on the undercarriage rearwardly of the driver's cabin. The collecting bin has a top portion and two side walls with a counterpressure plate pivotally mounted to the top portion of the refuse-collecting bin. The vehicle includes a charging system having a feeding mechanism for picking up refuse receptacles and emptying them into the charging system. A refuse-compacting device forms part of the refuse-charging system and is mounted forwardly of the refuse collecting bin and is capable of moving refuse rearward into the refuse collecting bin. At least one counterpressure plate is pivotally mounted on the top portion of the collecting bin a predetermined distance rearwardly of the refuse-compacting device. Hydraulic cylinders pivot the counterpressure plate forwardly so that the pressure applied to the refuse by the rearward movement of the refuse-compacting device is increased by the forward positioning of the counterpressure plate.

By placing the counterpressure plate provided by the present invention within the direct range of the refuse-compacting device, a pressing action starts immediately after only a small quantity of refuse has been loaded. This results in an intensive compaction of the refuse being accomplished in an advantageous way from the start of the charging operation onward. The pressure and counterpressure of the pressure plate of the refuse-compacting device and the counterpressure plate, respectively, can be adapted to one another in a way such that upon reaching optimal compacting of the refuse, the counterpressure plate yields by radially swinging to the rear or upwardly while maintaining its counterpressure. This clears additional space for the refuse following the plate.

By using the system according to the invention, the quantity of refuse loadable in the vehicle is significantly increased with the result that the refuse collecting vehicle is operating at its optimum capacity. After the counterpressure plate has reached its approximately horizontal final position, the refuse collecting bin is filled, and can be subsequently emptied in the known manner after a trap or door has been opened in the back wall of the bin.

These and other objects and advantages of the present invention will become apparent from the following description of the accompanying drawings, which disclose several embodiments of the invention. It is to be understood that the drawings are to be used for the purpose of illustration only, and not as a definition of the invention.

BRIEF DESCRIPTION OF THE DRAWINGS

In the drawings, where similar reference numerals denote similar elements throughout the several views:

FIG. 3 is a schematic side view of a refuse collecting vehicle according to yet another embodiment of the invention;

FIG. 4 is an enlarged view of the detail A—A from FIG. 3; and

DESCRIPTION OF THE PREFERRED EMBODIMENTS

Figure 1:
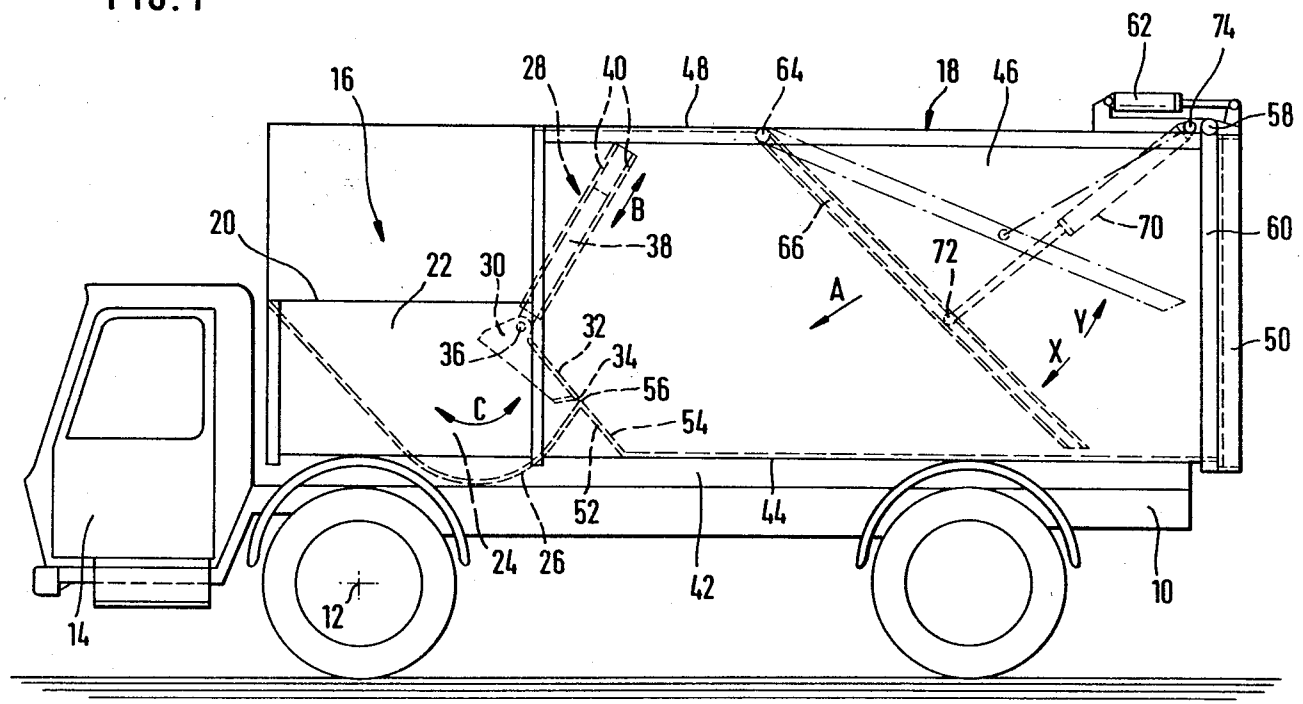
FIG. 1 is a schematic side view of a refuse collecting vehicle according to a first embodiment of the invention.

Referring to FIG. 1 there is shown a refuse collecting vehicle generally denoted as 8 with an undercarriage 10, which has a driver's cabin 14 mounted on a lower level in front of a front axle 12. A refuse-charging system 16, which is linked to a refuse-collecting bin 18 for receiving refuse, is installed behind driver's cabin 14. Refuse charging system 16 can be loaded both from the side and from the front ahead of driver's cabin 14.

In refuse collecting vehicle 8, refuse-charging system 16 is provided with a refuse inlet opening 20 disposed laterally across the top of vehicle 8. This refuse inlet opening 20 is connected to a filling hopper 22, which tapers to the width of bin 18 and a refuse-compacting space 24, which is connected to hopper 22 and which is shaped like a trough or tub.

At the top and on the sides up to the level of refuse inlet opening 20, refuse-charging system 16 is aligned or flush with side walls 46 of refuse collecting bin 18 and is covered in a way such that the lifted and tilted refuse receptacles (not shown) can be emptied in a well-known manner without any problems.

A refuse-compacting device 28 is arranged in refuse-compacting space 24 in an inclined position and displaceable in the longitudinal direction of refuse collecting vehicle 8 by the actuation of an actuating device, as indicated by the double arrow B. Refuse compacting device 28 is equipped with a swinging pressure plate 30 serving as the refuse-compacting plate. Plate 30 is pivotally supported about rotation point 36 of a base plate 38. With an actuating device (not shown in detail in the drawing), pressure plate 30 can be swung by about 180°, which is indicated by the double arrow C. Base plate 38 of the refuse-compacting device 28, furthermore, slides in the rails 40, and is driven in the two directions indicated by the double arrow B by means of the actuating device. Thus, any movement of the base plate 38 simultaneously moves the swinging pressure plate 30.

Refuse-collecting bin 18 is supported on the frame of undercarriage 10 by means of a base frame 42. In addition, refuse-collecting bin 18 has a bottom wall 44, two side walls 46 as well as a top part or ceiling 48. At its rear, refuse-collecting bin 18 is closed by a rear wall with a door or trap 50, which can be swung upwardly for emptying the bin.

Bottom wall 44 ends in the front part of refuse-collecting bin 18 in an upwardly angled leg 52, which is united with the bottom sheet 26 of refuse-compacting space 24 beneath pressure plate 30, forming an angle therewith. Thus, the front closure of the refuse-collecting bin is comprised of pressure plate 30, base plate 38 and leg 52.

Pressure plate 30 has a front wall 32, which is disposed in the same plane as inner side 54 of leg 52 when pressure plate 30 is in its final or end position as shown in FIG. 1. The bottom edge 34 of the pressure plate 30 and the leg edge 56 of the leg 52, when closest to one another, are positioned at such distance from one another that only a relatively small air gap is formed between the two. The rear wall door 50 is articulated in a point of rotation 58 of a bin closure frame 60 and can be opened and closed by means of a hydraulic operating cylinder 62.

A counterpressure plate 66 is pivotally connected at a point of rotation 64 at the rear closure of top part or ceiling 48. Counterpressure plate 66 is dimensioned in such a way that it is capable of absorbing high pressure forces acting against it in the direction of arrow A and such that it fits in the inside cross section of refuse-collecting bin 18. Furthermore, counterpressure plate 66 is capable of swinging around the point of rotation 64 in the directions indicated by the two arrows X and Y.

Counterpressure plate 66, which counteracts the pressure produced by pressure plate 30 and forms a counterpressure element for the refuse charged in refuse-collecting bin 18. Counterpressure plate 66 is acted upon by a pressure force in the operating direction (indicated by the arrow A), such pressure force being generated by one or a number of hydraulic operating cylinder(s) 70. The latter are pivotally connected at a point 72 on counterpressure plate 66 and at a point 74 on bin closure frame 60.

When counterpressure plate 66 is completely swung upwardly in the direction of arrow Y, it covers the associated range of refuse-collecting bin 18 and thus serves as a ceiling for the bin. In the lowered state, i.e., when swung downwardly in the direction of arrow X, counterpressure plate 66 approaches pressure plate 30 of refuse-compacting device 28. The approach of counterpressure plate 60 to pressure plate 30 is such that a compacting pressure is generated even with only a small quantity of refuse between the pressure plate 30 and the counterpressure plate 66. In this position, lowered counterpressure plate 66 is initially disposed approximately parallel with pressure plate 30.

The pressure forces for the pressure plate 30 and the counterpressure plate 66 are produced by associated operating cylinders and controlled or adjusted in a well-known manner by pressure control valves (not shown in the drawing) to values required for optimal compacting of the refuse. Such valves may be controllable overflowing oil pressure valves.

Therefore, as refuse is being charged by pressure plate 30, the position of counterpressure plate 66 is maintained by operating cylinders 70 until the required degree of refuse-compaction has been reached. Only as additional quantities of refuse are being charged and the compaction pressure is exceeded, counterpressure plate 66 pivots radially about point 64 in the upward direction as indicated by arrow Y, whereby the compaction pressure remains constant as additional refuse is being charged.

Figure 5:
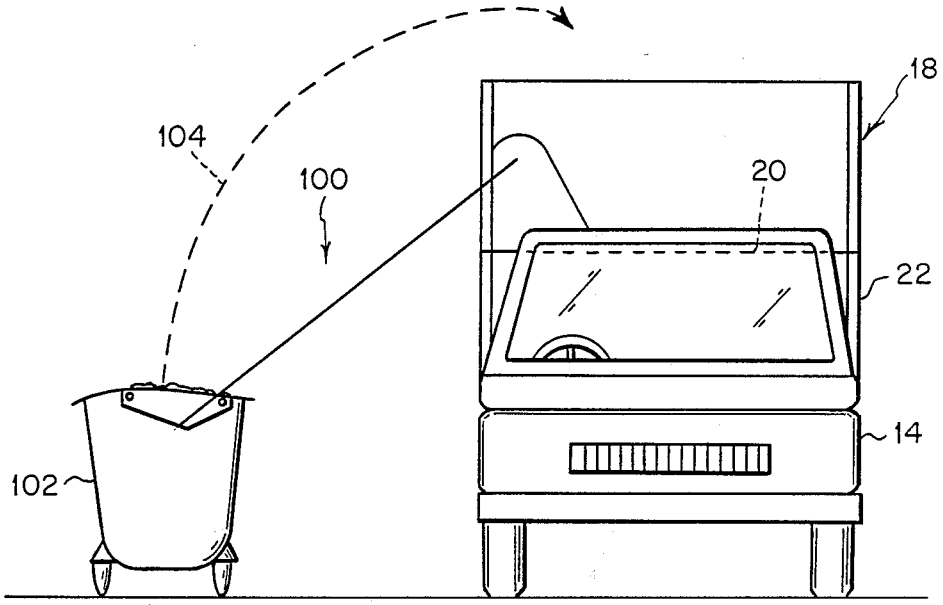
FIG. 5 is a schematic front view of a refuse-collecting vehicle according to the present invention, showing a charging system for the refuse receptacles.

As clearly seen in FIG. 5, refuse receptacles 102 to be emptied are engaged by a charging mechanism, such as laterally arranged side loader 100 and receptacle 102, is then lifted and tilted, as showing by dotted line 104, and the contents of refuse receptacle 102 is emptied through refuse inlet opening 20 and into charging hopper 22. From the latter, the refuse passes into refuse-compacting space 24 where it is seized by the pressure plate 30 which has already been swung back and raised. Utilizing pressure plate 30, which is now swinging in the direction of refuse-collecting bin 18 the refuse is pressed into the collecting bin, whereby base plate 38, together with the pressure plate 30, simultaneously moves upwardly following a sloped line. Subsequently, the refuse is further compacted with the help of counterpressure plate 66.

Figure 2:
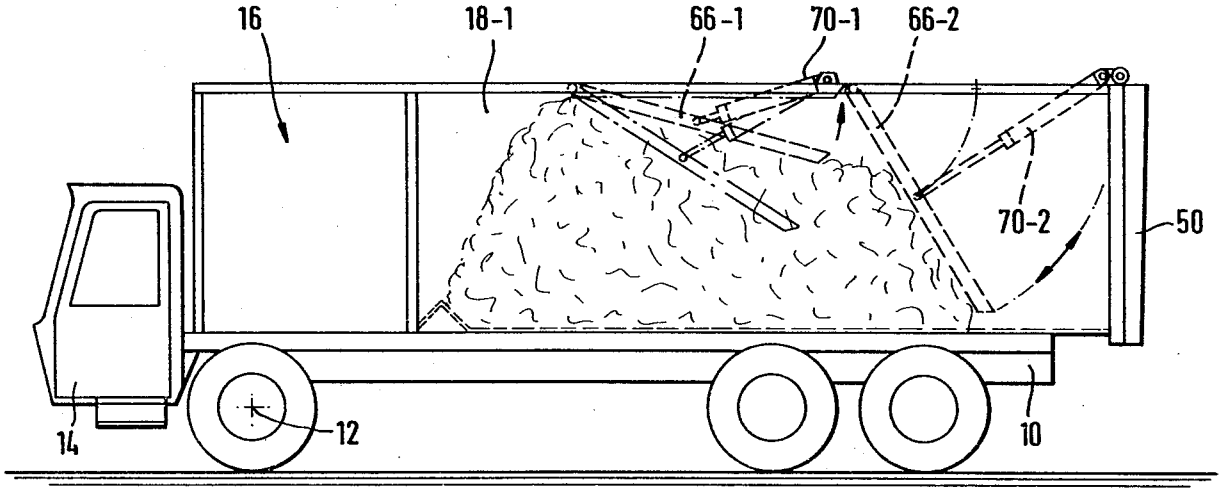
FIG. 2 is a schematic side view of a refuse collecting vehicle according to a second embodiment of the invention.

Referring to FIG. 2, there is shown a second embodiment of the invention. In order to achieve a high degree of compaction and a uniform compacting across the length of refuse-collecting bin 18-1 which in this case, is a very long refuse container, provision is made in this embodiment for two counterpressure plates 66-1 and 66-2. Counterpressure plates 66-1 and 66-2 along with the associated hydraulic operating cylinders 70-1 and 70-2, respectively, are in a staggered arrangement one after the other. The forward counterpressure plate 66-1 becomes active first and the refuse is later subjected to the action of the rearward counterpressure plate 66-2.

Referring to FIGS. 3 and 4, still another embodiment of the refuse-collecting vehicle according to the invention is shown. In this embodiment, the forward part of ceiling 48-1 of refuse-collecting bin 18 is relatively short, whereas counterpressure plate 66-3 which radially swings around pivot point 64-1, is extended correspondingly to the rear of the vehicle.

A curved top plate 78, whose curvature matches the arc of rotation of counterpressure plate 66-3, is disposed on rear wall door 50 on the inside thereof. The outer circular arc described when the counterpressure plate 66-3 performs a swinging motion thus is adapted to the curvature of the curved plate 78. Referring to FIG. 4, the space between the end 68 of counterpressure plate 66-3 and the inner surface 80 of curved plate 78 is bridged or sealed by a sealing element 82.

In the embodiment shown in FIG. 3, counterpressure plate 66-3 swings downwardly only to about the center of refuse-collecting bin 18, for which reason the curved plate 78 ends there as well. The lower zone of the rear wall door 50 is closed by a lower curved plate 84 which is shaped symmetrically relative to curved top plate 80.

The pressure applying means moving counterpressure plate 66-3 both in the direction of arrows X and Y, that is, upwardly or downwardly, in the form of hydraulic tension and pressure cylinders 86. It has been found preferable to use the pulling motion of cylinders 86 for the operation in the direction of arrow A. Hydraulic operating cylinders 86 are mounted outside of the refuse-collecting bin 18 directly next to the two side walls 46 and each cylinder is articulated about pivot point 88 on the bin frame.

For transmitting the force, counterpressure plate 66-3 includes pins 90 on each of its two outer sides. Each of the two pins 90 extends outwardly through a slot-like cutout 92 radially cut in side walls 46 of refuse-collecting bin 18. The piston rods 94 of operating cylinders 86 are articulated and fastened to pins 90.

While refuse-collecting bin 18 according to FIG. 3 is charged as explained earlier in connection with FIG. 1, the refuse is compacted in a slightly different manner. In FIG. 3, the refuse-collecting bin 18 is first filled with refuse across its entire length and counterpressure plate 66-3 starts to function after the bin has been filled to about half of its height.

As additional refuse is charged, the refuse is compacted by counterpressure plate 66-3 downwardly against bottom wall 44 across a gradually increasing length of action of the plate. At the same time, pressure plate 30 of the refuse-compacting device 28, as shown in FIG. 1, acts in the longitudinal direction so that intensive compaction of the refuse is achieved up to the maximum limit of refuse-collecting bin 18 by the total and joint action of the two pressure-applying elements in opposite directions.

The refuse-collecting vehicle according to the invention is useable regardless of the type of undercarriage and possible variations in the superstructures of the vehicles, and not in any way limited to the embodiments described herein. The foregoing description is illustrative of the present invention and various modifications and embodiments have been suggested and others will be readily apparent to those skilled in the art without departing from the spirit and scope of the invention.

What is claimed:

1. A refuse-collecting vehicle comprising: an undercarriage;

a driver's cabin mounted on a forward portion of the undercarriage;

a refuse-collecting bin mounted on the undercarriage rearwardly of the driver's cabin, said refuse-collecting bin having sidewalls and a top portion;

a refuse-charging system for conveying refuse into said refuse collection bin;

a means associated with said vehicle for picking up refuse receptacles and for emptying said refuse into said refuse-charging system;

a refuse-compacting means forming part of said refuse-charging system mounted forwardly of said refuse-collecting bin for moving refuse rearwardly into said refuse-collecting bin;

at least one counterpressure plate pivotally mounted on said top portion of said refuse-collecting bin a predetermined distance rearwardly of said refuse-compacting means; and a means for pivoting said at least one counterpressure plate forwardly so that the pressure applied to said refuse by the rearward movement of said compacting means is increased by the forward positioning of said counterpressure plate to provide a uniform compaction of said refuse.

2. The refuse-collecting vehicle as set forth in claim 1 wherein said counterpressure plate extends between the side walls of said refuse-collecting bin forming in a raised state said top portion of said refuse-collecting bin.

3. The refuse-collecting vehicle as set forth in claim 1 wherein said means for pivoting said at least one counterpressure plate are hydraulic cylinders with controllable, overflowing oil pressure valves.

4. The refuse-collecting vehicle as set forth in claim 1 wherein said means for pivoting said at least one counterpressure plate are double acting hydraulic cylinders.

5. The refuse-collecting vehicle as set forth in claim 1 wherein two counterpressure plates are arranged in series along the longitudinal extent of said refuse-collecting bin.

6. The refuse-collecting vehicle as set forth in claim 1 wherein said refuse-collecting bin includes a rear wall, said rear wall including a curved plate supported on an upper portion of the inside of said rear wall, the curvature of said plate being adapted to the outer circular arc formed by an end of said counterpressure plate as said plate pivots, said end of said pivotal counterpressure plate includes a gasket mounted between said counterpressure plate and an inner surface of said curved plate.

7. The refuse-collecting vehicle as set forth in Claim 1 wherein said refuse-collecting bin has a bottom wall, said bottom wall having a forward portion formed by an upwardly extending leg, said leg being connected to a pressure plate of said refuse-compacting device.

* * * * *